United States Patent [19]

Casagrande

[11] Patent Number: 4,995,831

[45] Date of Patent: Feb. 26, 1991

[54] ELECTRICAL CONNECTOR SUPPORT

[75] Inventor: Mario Casagrande, Turin, Italy

[73] Assignee: AMP Incorporated, Harrisburg, Pa.

[21] Appl. No.: 358,099

[22] Filed: May 26, 1989

[30] Foreign Application Priority Data

Jun. 3, 1988 [GB] United Kingdom ..... 8813234

[51] Int. Cl.[5] ..... H01R 13/74

[52] U.S. Cl. ..... 439/557; 439/563

[58] Field of Search ..... 439/557, 558, 549, 552, 439/563, 567, 570, 569, 571, 574, 575, 701, 465, 467

[56] References Cited

U.S. PATENT DOCUMENTS

| | | | |
|---|---|---|---|
| 3,537,061 | 10/1970 | Haag et al. . | |
| 4,159,158 | 6/1979 | Kaucic et al. | 439/711 |
| 4,408,823 | 10/1983 | Huber | 439/465 |
| 4,444,450 | 4/1984 | Huber | 439/465 |
| 4,854,892 | 8/1989 | Vignoli | 439/417 |

FOREIGN PATENT DOCUMENTS

| | | |
|---|---|---|
| 2447105 | 1/1979 | France . |
| 1584909 | 2/1981 | United Kingdom . |
| 2140981 | 5/1984 | United Kingdom . |

*Primary Examiner*—Gary F. Paumen

*Attorney, Agent, or Firm*—William B. Noll

[57] ABSTRACT

The present invention is directed to a connector support system which utilizes an interlocking mechanism. More particularly, such connector support has, along one surface thereof, a plurality of parallel ribs which are adapted to slidably engage a plurality of parallel slots in the side of a connector housing, and means for latching same to the housing. This system allows for the flexibility of interchangeability between the connector housing and support. For example, one side of said support is identical for all embodiments thereof, while the opposite side is unique by means which permit joining of said support to a board or other connection means.

5 Claims, 4 Drawing Sheets

ELECTRICAL CONNECTOR SUPPORT

BACKGROUND OF THE INVENTION

The present invention relates to a support mechanism for use with an electrical connector which, for example, may comprise an electrical connector of the type as disclosed in U.S. Pat. No. 4,854,892. While the invention has broad application to a variety of electrical connectors, an exemplary connector is one in which a conductor can be terminated by forcible insertion transversely of its axis along a conductor receiving slot of a contact member. Such contact member is mounted in a cavity in an insulating housing body adjacent one end and retained in the slot by engagement with a cover member movable into latching engagement with the housing body to engage the conductor thereby to retain the conductor in the slot.

In connectors of this type, the cover member is provided with latching projections engageable in eyes formed in the housing body adjacent a cover member receiving end to latch the cover member to the housing body, and by an internal latching mechanism which secures the cover to said contact member.

Such connectors have become increasingly widely used, particularly in the automotive and appliance industries as they are well adapted for assembly by automated, mass production, techniques and yet ensure a very reliable, insulated, electrical connection to the conductor for use in adverse environments subject to vibration.

Oft times, for an automobile or appliance, connector housings, after termination, must be secured therein. The present invention provides a means to accomplish this by providing an intermediate support system between said housing and the automobile or appliance. The present invention achieves this end by a rib and groove interlocking arrangement, and by one or more latching arms.

Rib and groove interlocking systems have been used in the past to join modular units to form a unitary body. Such a system is taught in U.S. Pat. No. 3,537,061 wherein there is disclosed a plurality of telephone jack units which are slidably interconnected to each other to form a unitary telephone jack having a plurality of such units.

SUMMARY OF THE INVENTION

According to the present invention, a rib and groove concept, in concert with one or more latching arms is used to provide a simple means to engage and lock a connector housing to a board or other means. More particularly, this is achieved hereby in an electrical connector adapted to be secured to a mounting board, connection support or the like, where the connector comprises a housing with at least one major face, one or a row of elongate cavities therein opening to a cover receiving end and a mating end, and a contact member for each said cavity for terminating a conductor. Additionally, there is the provision of a support having means for slidably engaging said major face, and one or more flexible arms for engaging the housing along a portion of said major face.

An example in the application of such concept according to this invention will now be described with reference to the accompanying drawings.

DETAILED DESCRIPTION OF PREFERRED EMBODIMENT

Figure 1:
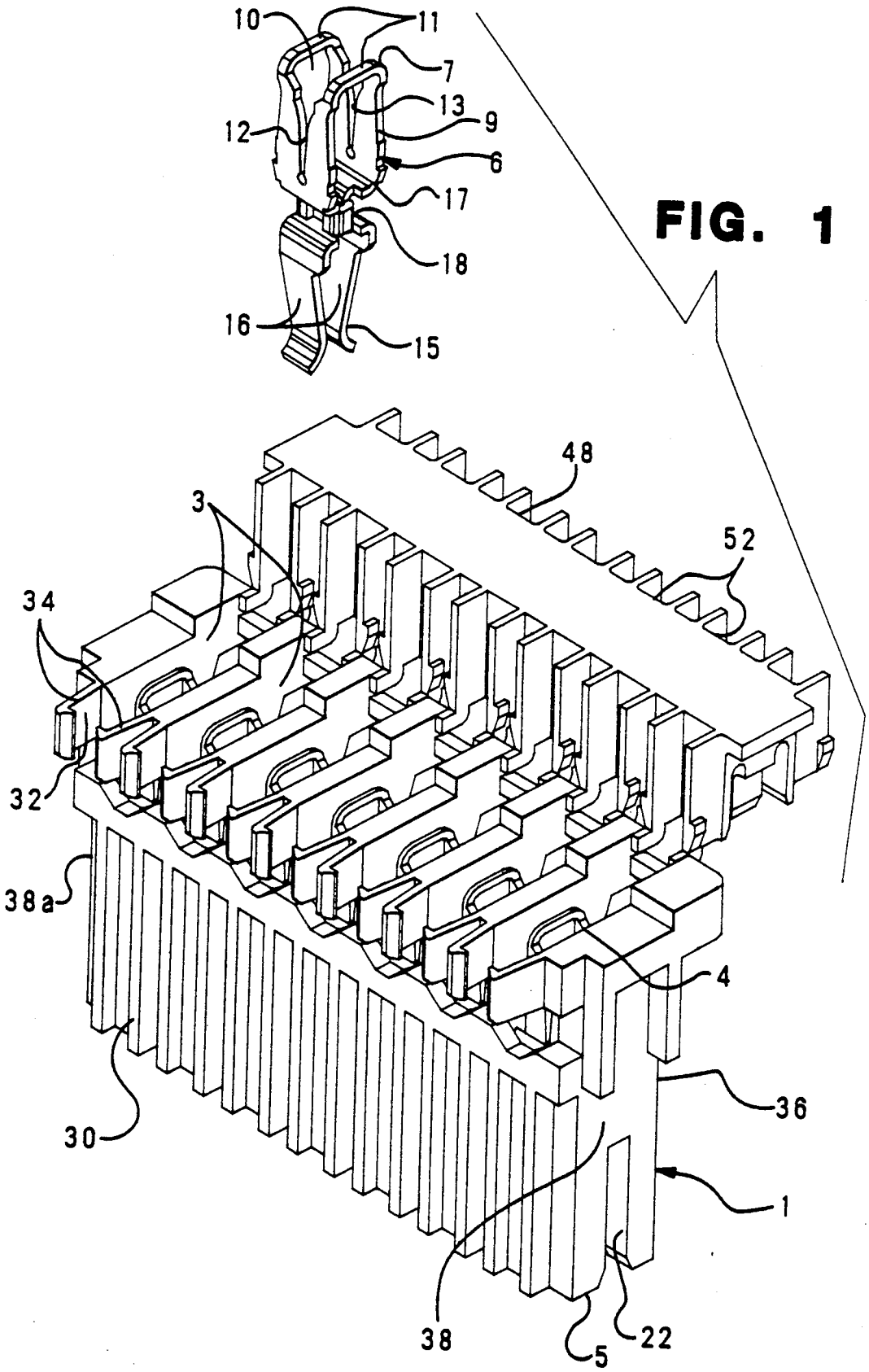
FIGURE 1 is a front perspective view illustrating details of a typical connector housing of this invention, showing a typical contact member poised for entry into said housing.
Figure 2B:
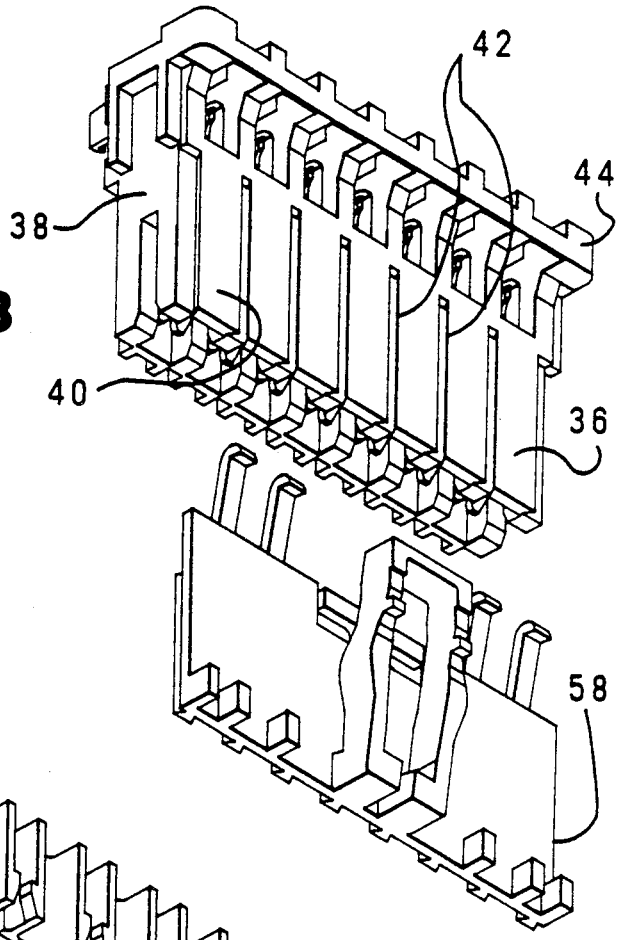
FIG. 2B is a perspective view similar to FIG. 2A, but showing an electrical connector support of this invention prior to joining same to the housing.
Figure 2A:
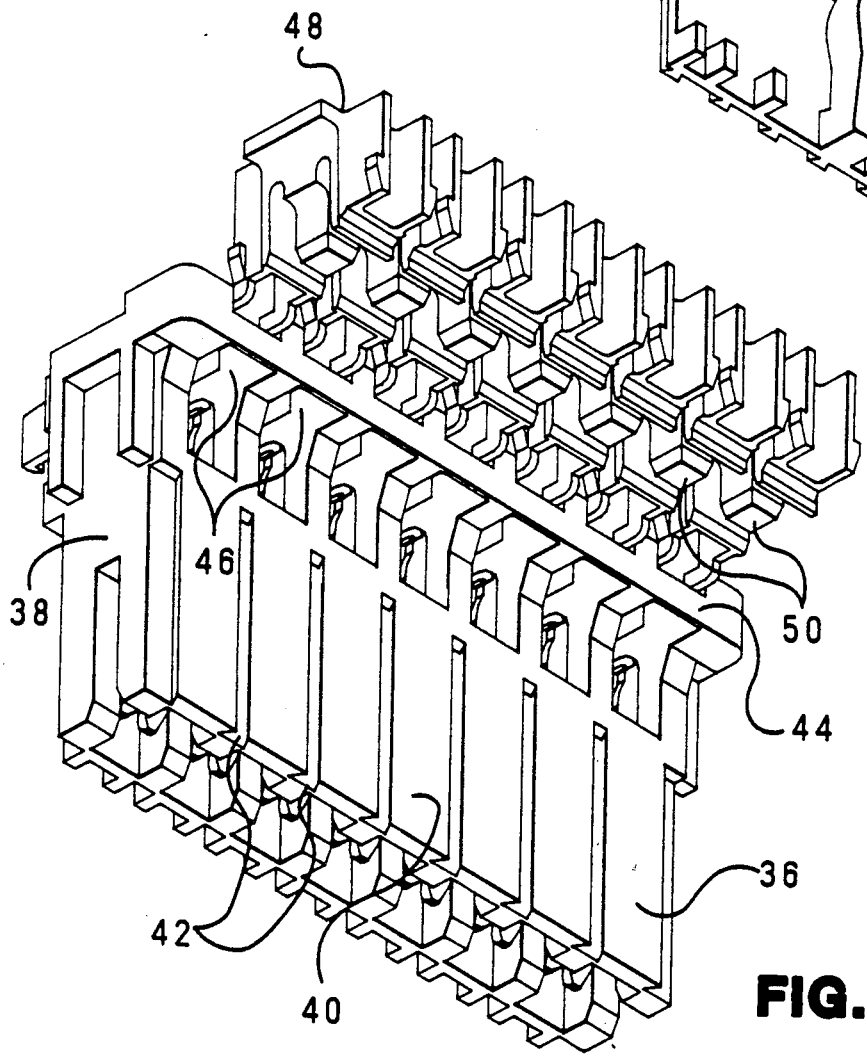
FIG. 2A is a rear perspective view of the housing of FIG. 1.

In the practice of this invention a typical electrical connector comprises a housing body 1 and cover member which may be molded in one piece of a plastic insulated-type material, as illustrated in FIGS. 1 and 2A. The housing body 1 is formed with one or a row of elongate cavities 3 opening to opposite cover member receiving and mating ends 4 and 5 respective of the housing body, where each cavity 3 receives a contact member 6 of generally known form.

Each contact member 6, as illustrated in FIG. 1, may be stamped and formed in one piece from sheet metal strip and comprises a conductor connecting end 7, constituted by a pair of interconnected parallel plates 9 joined by a pair of transverse straps 11, to define a wire receiving mouth 10 converging to a pair of aligned wire receiving slots 12 and 13 in respective plates. The tab or board receiving end 15 is constituted by a pair of limbs 16 extending in opposed relation from an intermediate, waisted, portion 17 at which ears 18 extending from one strip portion are clinched around an opposite strip portion to secure the plates 9 and limbs 16 together. When a contact member 6 is inserted into a cavity 3, the straps 11 engage shoulders formed on opposed end walls of the cavities 3 thereby preventing further movement into the cavity and providing support for the contact during wire insertion, as described in UK Patent application No. 1584909 or U.S. Pat. No. 4,159,158.

At the opposite end of housing body 1, the mating end 5 thereof is formed with a printed circuit board or tab receiving slot 22 aligned with respective board or tab receiving ends 15 of the respective contact members 6.

Externally, the housing body 1 comprises a front wall 30 having openings 32 between projecting arms 34 for engaging wires or conductors, particularly if such conductors are caused to be bent 90° and project vertically from said housing.

The rear wall 36 thereof, as best seen in FIGS. 2A and 2B, joined to front wall 30 by side walls 38, **38*a*, is characterized by a vertical face 40 having a plurality of tapered grooves 42 over a portion of the length of such face. In addition, along the top of face 40, a shoulder 44 is provided in which there is found a plurality of openings 46. The function of such openings and grooves 42** will become apparent hereinafter.

A preferred cover member 48 for the housing hereof comprises a row of segments 50 interconnected by webs 52. Each segment 50 is shaped for receipt in the cavity 3 in the cover member receiving end 4, with the webs 52 then overlying the walls between adjacent cavities. Typically, the cover contains a plurality of segments 50, a number which is consistent with the number of cavities 3 and openings 46 in the housing body 1. By means taught in UK Patent Application 8726808, the cover member 48 may be firmly latched to housing body 1. Such latching, of course, occurs after wires or conductors have been suitably terminated in contact members 6, see FIG. 3.

Figure 4A:
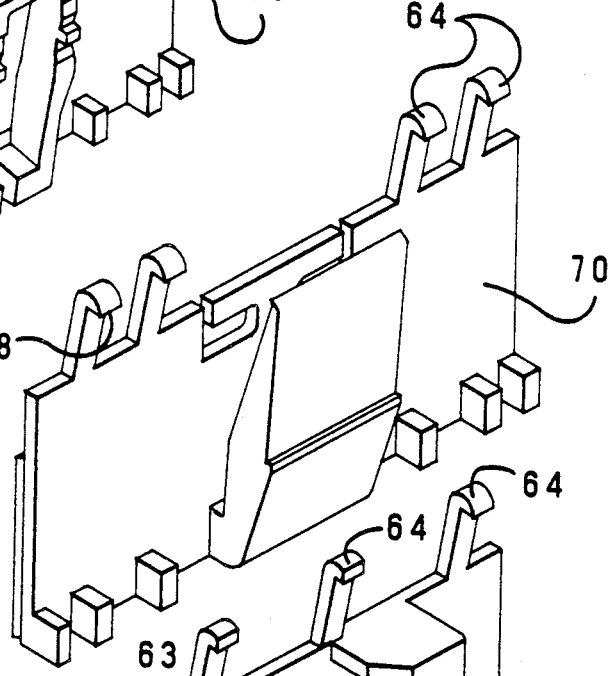
FIGS. 4A–4D are perspective views of electrical connector supports as taught by this invention.
Figure 4B:
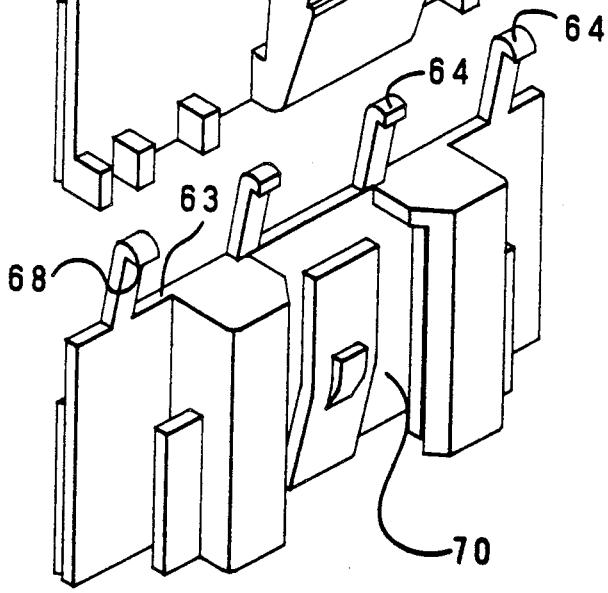
Figure 4C:
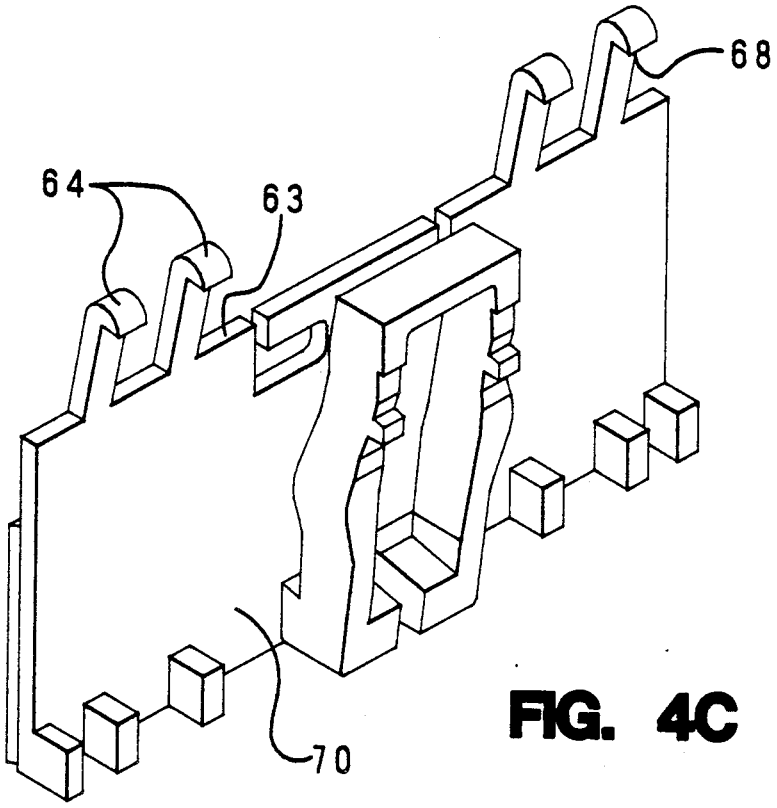
Figure 4D:
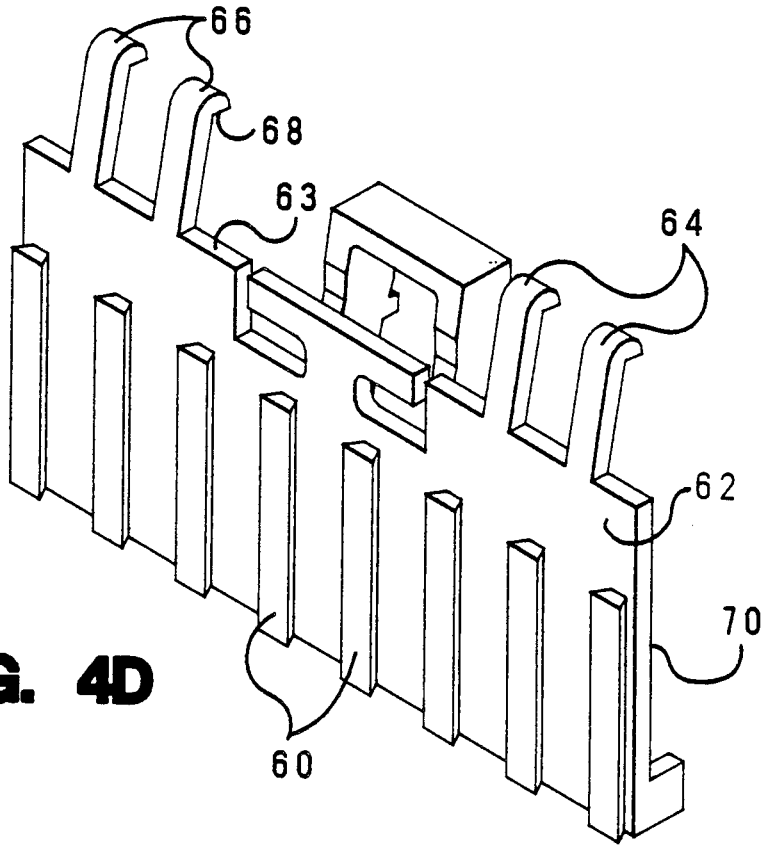

In such terminated condition it is often necessary to secure the connector in a location that may not be readily accessible. The present invention provides for interchangeable supports 58 to which such connector may be joined. While the latching mechanism for the various supports may vary, three exemplary supports are illustrated in FIGS. 4A to 4C. They share common features illustrated in FIG. 4D, in that each are characterized by a plurality of parallel, tapered ribs 60 extending over a portion of the side 62. Additionally, extending from the top edge 63 thereof, there are provided at least a pair of flexible arms 64 extending generally in a direction parallel to ribs 60, but slightly angled in a direction away from the plane formed by side 62. The remote ends 66 thereof are provided with an upturned latching projection 68, adapted to be latched in openings 46 around shoulder 44. In operation, the housing body 1 is brought into engagement with the support by sliding engagement of the ribs 60 into grooves 42. As the housing body 1 is moved along such ribs 60, the arms 64 come into contact with shoulder 44 and are flexed toward the plane of side 62 until the ends 66 are free of the shoulder 44. At this point, the latching projection 68 returns to its unflexed position in latching relation to the shoulder 44.

Figure 3:
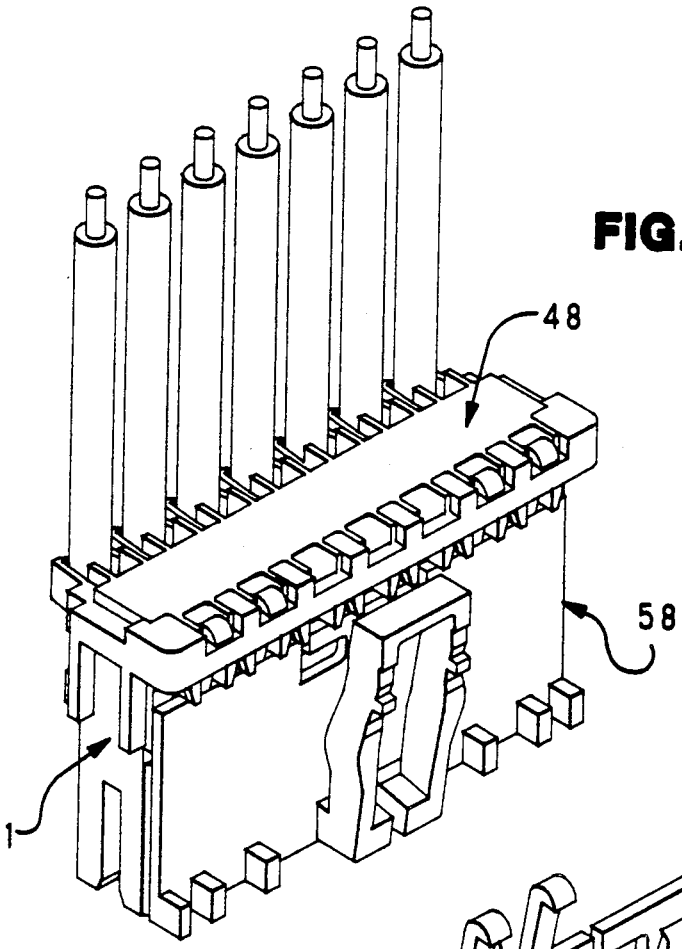
FIG. 3 is a perspective view of a typical assembled connector housing with connectors terminated and bent 90° as they exit the housing body.

The ribs 60 are of such a cross-section as to slidably engage the corresponding and complementary grooves 42. This interconnection, coupled with the latching of arms 64 within openings 46, around shoulder 44, ensure a secure connection between the housing body 1 and support 58, as shown in FIG. 3.

The reverse side 70 of each support 58 is characterized by some type of latching mechanism, as best seen in FIGS. 4A to 4C, by which such support may be secured to a suitable mounting board. The particular design of such latching mechanism does not form a part of this invention.

What is claimed is:

1. An electrical connector adapted to be secured to a surface such as a mounting board or connection support, wherein said connector comprises a housing with at least one major face, one or a row of elongate cavities therein opening to a cover receiving end and a mating end, and a contact member for each said cavity for terminating a conductor, including the provision of a support having means for slidably engaging said major face, and one or more flexible arms, each said arm for engaging the housing through a respective opening along a shoulder portion of said major face adjacent said cover receiving end.

2. The electrical connector and support according to claim 1, wherein the means for slidably engaging said housing and said support comprise a plurality of complementary grooves and ribs.

3. The electrical connector and support according to claim 1, wherein said support includes a face which lies adjacent to said major face in supporting engagement, and that said flexible arms are angled away from the plane formed by said support face.

4. The electrical connector and support according to claim 1, wherein means are provided on said support for engagement with a suitable mounting board.

5. The electrical connector and support according to claim 3, wherein means are provided on said support for engagement with a suitable mounting board.

* * * * *